US011330837B2

(12) United States Patent
Clarke et al.

(10) Patent No.: US 11,330,837 B2
(45) **Date of Patent: *May 17, 2022**

(54) FLOW CONTROL DEVICE

(71) Applicant: British American Tobacco (Investments) Limited, London (GB)

(72) Inventors: Shane Clarke, London (GB); Paul Barry Farenden, London (GB); David Morrison Russell, London (GB); David Spendlove, London (GB)

(73) Assignee: NICOVENTURES TRADING LIMITED, London (GB)

( * ) Notice: Subject to any disclaimer, the term of this patent is extended or adjusted under 35 U.S.C. 154(b) by 768 days.

This patent is subject to a terminal disclaimer.

(21) Appl. No.: 15/320,921

(22) PCT Filed: Jun. 30, 2015

(86) PCT No.: PCT/GB2015/051904

§ 371 (c)(1),
(2) Date: Dec. 21, 2016

(87) PCT Pub. No.: WO2016/001648

PCT Pub. Date: Jan. 7, 2016

(65) Prior Publication Data

US 2017/0127719 A1 May 11, 2017

(30) Foreign Application Priority Data

Jun. 30, 2014 (GB) ..... 1411619

(51) Int. Cl.
*A24D 3/04* (2006.01)
*A24D 3/06* (2006.01)

(52) U.S. Cl.
CPC ..... *A24D 3/043* (2013.01); *A24D 3/041* (2013.01); *A24D 3/048* (2013.01); *A24D 3/061* (2013.01); *A24D 3/04* (2013.01)

(58) Field of Classification Search
None
See application file for complete search history.

(56) References Cited

U.S. PATENT DOCUMENTS

| | | | |
|---|---|---|---|
| 2,954,035 | A | 9/1960 | Saffir |
| 2,968,305 | A | 1/1961 | Mazar |
| 3,016,902 | A | 1/1962 | Lipp |
| 3,310,056 | A | 3/1967 | Rieder |
| 3,330,284 | A | 7/1967 | Seman |

(Continued)

FOREIGN PATENT DOCUMENTS

| | | | |
|---|---|---|---|
| EP | 0105683 | A1 | 4/1984 |
| EP | 0234911 | A1 | 9/1987 |

(Continued)

OTHER PUBLICATIONS

International Search Report and Written Opinion , dated Aug. 9, 2012 for PCT/GB2012/051041, filed Nov. 5, 2012.

(Continued)

*Primary Examiner* — Phu H Nguyen
(74) *Attorney, Agent, or Firm* — Cantor Colburn LLP

(57) ABSTRACT

A flow control device (14) for a smoking article (10) is provided. The device comprises first and second selector parts (18, 19) to control flow along a plurality of controllable flow channels.

13 Claims, 7 Drawing Sheets

(56) References Cited

U.S. PATENT DOCUMENTS

| | | | |
|---|---|---|---|
| 3,359,988 | A | 12/1967 | Thomson |
| 3,366,122 | A | 1/1968 | Brothers |
| 3,376,874 | A | 4/1968 | Kim |
| 3,428,050 | A | 2/1969 | Kandel |
| 3,503,406 | A | 3/1970 | Riegel |
| 3,650,278 | A | 3/1972 | Cook |
| 4,059,043 | A | 11/1977 | Berger |
| 4,433,696 | A | 2/1984 | Adams |
| 4,527,573 | A | 7/1985 | Hausermann |
| 4,532,943 | A | 8/1985 | Nichols |
| 4,559,955 | A | 12/1985 | Brockway et al. |
| 4,593,707 | A | 6/1986 | Seidel |
| RE32,221 | E | 8/1986 | Adams |
| 4,649,941 | A | 3/1987 | Norman et al. |
| 4,649,944 | A | 3/1987 | Houck |
| 4,677,995 | A | 7/1987 | Kallianos |
| 4,687,008 | A | 8/1987 | Houck |
| 4,848,375 | A | 7/1989 | Patron |
| 4,898,190 | A | 2/1990 | Deal |
| 8,640,713 | B2 | 2/2014 | Fiebelkorn |
| 8,960,197 | B2 | 2/2015 | Bailey et al. |
| 8,960,198 | B2 | 2/2015 | Bailey |
| 2006/0174901 | A1 | 8/2006 | Karles et al. |
| 2007/0012327 | A1 | 1/2007 | Karles |
| 2008/0142028 | A1 | 6/2008 | Fagg |
| 2012/0186593 | A1 | 7/2012 | Grano |
| 2013/0032161 | A1 | 2/2013 | Herholdt |
| 2014/0069447 | A1 | 3/2014 | Bailey |
| 2014/0096785 | A1 | 4/2014 | Bailey |
| 2014/0166031 | A1 | 6/2014 | Bailey |

FOREIGN PATENT DOCUMENTS

| | | | | |
|---|---|---|---|---|
| EP | 0317154 | A1 | 5/1989 | |
| EP | 0671131 | A1 * | 9/1995 | ..... A24D 3/041 |
| EP | 0671131 | A1 | 9/1995 | |
| EP | 1512926 | A2 | 3/2005 | |
| GB | 1264700 | | 2/1972 | |
| GB | 2020537 | A | 11/1979 | |
| JP | H0732110 | B2 | 4/1995 | |
| JP | 07298866 | A | 11/1995 | |
| JP | 2005106452 | A | 4/2005 | |
| JP | 2008503694 | A | 2/2008 | |
| JP | 2013518569 | A | 5/2013 | |
| JP | 2014513539 | A | 6/2014 | |
| KR | 20070026622 | A | 3/2007 | |
| KR | 20120101423 | A | 9/2012 | |
| KR | 20130009825 | A | 1/2013 | |
| KR | 20140018284 | A | 2/2014 | |
| KR | 20140032437 | A | 3/2014 | |
| WO | 8401273 | A1 | 4/1984 | |
| WO | 2005124207 | A1 | 12/2005 | |
| WO | 2006082529 | A2 | 8/2006 | |
| WO | 2011039302 | A1 | 4/2011 | |
| WO | 2011051115 | A1 | 5/2011 | |
| WO | 2011077314 | A1 | 6/2011 | |
| WO | 2011095410 | A1 | 8/2011 | |
| WO | 2012156697 | A1 | 11/2012 | |
| WO | WO-2012156697 | A1 * | 11/2012 | ..... A24D 3/048 |
| WO | 2013116558 | A1 | 1/2013 | |
| WO | 2013068398 | A1 | 5/2013 | |
| WO | 2013127810 | A1 | 9/2013 | |

OTHER PUBLICATIONS

Written Opinion of the International Preliminary Examining Authority, dated Aug. 7, 2012 for PCT/GB2012/051041, filed Nov. 5, 2012.
International Search Report for corresponding application PCT/GB2015/051904 filed Jun. 30, 2015; dated Sep. 28, 2015.
Notification of Transmittal of the International Preliminary Report on Patentability, dated Sep. 13, 2013 for PCT/GB2012/051041, filed Nov. 5, 2012.
Office Action dated Jul. 15, 2014 for U.S. Appl. No. 14/117,418.
Office Action dated May 22, 2014 for U.S. Appl. No. 14/080,402.
Office Action dated May 23, 2014 for U.S. Appl. No. 14/080,487.
Office Action for corresponding application U.S. Appl. No. 14/117,418 dated Jun. 8, 2016.
Office Action for corresponding application U.S. Appl. No. 14/117,418 dated Oct. 7, 2016.
Office Action, dated Nov. 2, 2014, for CN Application No. 2012-80023154.1 [English Translation].
Search Report, dated Oct. 24, 2014, for CN Application No. 2012-80023154.1 [English Translation].
Translation of Office Action for Korean Patent Application No. 10-2013-7033092 dated Jul. 17, 2015.
Written Opinion of the ISA for corresponding application PCT/GB2015/051904 filed Jun. 30, 2015; dated Sep. 28, 2015.
KR Notice of Allowance dated Aug. 20, 2020 re: Application No. 10-2017-7002701, pp. 1-6, citing: KR1020140032437 A, KR1020070026622 A, KR1020120101423 A, KR1020130009825 A, KR1020140018284 A, JP2008503694 A, JP2005106452 A, EP0671131 A1 and WO2013116558 A1.
JP Search Report dated Dec. 22, 2017 re: Application No. 2016-575445, pp. 1-30, citing: JP 2014-513539 A, US 04898190 A, JP 2013-518569A, WO 2013/068398 A1, JP S59-098676 A, US 04559955 A and US 04649941 A.

* cited by examiner

FLOW CONTROL DEVICE

CROSS REFERENCE TO RELATED APPLICATIONS

This application is related to U.S. patent application Ser. No. 14/080,402 filed on Nov. 14, 2013 (now U.S. Patent No. 8,960,197) and to U.S. patent application Ser. No. 14/080,487 filed on Nov. 14, 2013 (now U.S. Patent No. 8,960,198), both of which said applications are continuations of U.S. patent application Ser. No. 14/117,418 on Nov. 13, 2013 under 35 USC 371 as the U.S. national stage of International Patent Application Number PCT/GB2012/051041 filed on May 11, 2012 which claims priority to United Kingdom Patent Application Number GB1108034.8 filed on May 13, 2011, all of which said applications are herein cross referenced and incorporated by reference in their entirety.

FIELD

The invention relates, among other things, to a flow control device, and a method of manufacturing a flow control device.

BACKGROUND

It is known to provide smoking articles which, in use, provide smoke in which a flavourant is entrained.

SUMMARY

In accordance with a first embodiment, there is provided a flow control device for a smoking article. The device comprises first and second selector parts to control flow along a plurality of controllable flow channels. The first and second selector parts are is arranged to be axially displaceable to determine the number of controllable flow channels along which flow may be drawn.

The first and second selector parts may be configured to control flow through the flow control device in response to user action.

All of the controllable flow channels may be opened or closed by means of the axial displacement of the first and second selector parts. A controllable flow channel is a flow channel that can be opened or completely closed in response to user action. Moreover, a controllable flow channel is directly controllable, and a controllable flow channel does not include flow channels in which the level of flow may only be adjusted indirectly, for example as a result of the operation of a separate, directly controllable flow channel.

A first portion of one of the selector parts may comprise a first channel and a second portion of one of the selector parts may comprise a second channel. The first channel may extend axially further along the flow control device than the second channel. In a first position of relative axial displacement of the first and second selector parts, flow may be drawn along the first but not the second channel. In a second position of relative axial displacement of the first and second selector parts, flow may be drawn along the first and second channels.

The first selector part may comprise a first surface and the second selector part may comprise a second surface. The controllable flow channels may comprise flow between the first and second surfaces. The controllable flow channels may not comprise flow through an opening encompassed by either of the first or second surfaces.

The first and second surfaces may be in contact in all relative positions of axial displacement of the first and second selector parts.

The first selector part may comprise a cylindrical portion and the first surface may comprise the outer circumferential surface of the cylindrical portion. In addition, the second selector part may comprise a tubular portion, and the second surface may comprise the cylindrical inner surface of the tubular portion. In this case, the cylindrical portion of the first selector part may fit within a receiving end of the tubular portion of the second selector part.

The second surface may comprise first and second channels, which channels may open at, and extend from, the receiving end of the second surface. The first channel may extend further from the receiving end than the second channel.

In a first relative position of axial displacement of the first and second selector parts, in use flow may be drawn between the first and second surfaces along the first but not the second channel.

In a second relative position of axial displacement of the first and second selector parts, in use flow may be drawn between the first and second surfaces along both the first and second channels.

The controllable flow channels may be controllable smoke flow channels.

In accordance with a second embodiment, there is provided a filter for a smoking article comprising a flow control device in accordance with the first embodiment.

The filter may comprise first and second filter parts. The first filter part may comprise a smoke modifying agent, and flow through the first filter part may be controlled by the flow control device. The second filter part may be disposed around the first filter part.

In accordance with a third embodiment, there is provided a smoking article comprising a flow control device in accordance with the first embodiment, or a filter in accordance with the second embodiment.

BRIEF DESCRIPTION OF THE DRAWINGS

Embodiments will now be described, by way of example only, with reference to the accompanying drawings, in which:

FIG. 6A shows the selector in a closed position;

FIG. 6B shows the selector in a first ("low") open position;

FIG. 6C shows the selector in a second ("medium") open position;

FIG. 6D shows the selector in a third ("high") open position;

FIG. 7A shows the residence time of smoke drawn through the filter when the smoking article is in use in the closed position; and, FIG. 7B shows the residence time of smoke drawn through the filter when the smoking article is in use in the third ("high") open position.

DETAILED DESCRIPTION

As used herein, the term "smoking article" includes smokable products such as cigarettes, cigars and cigarillos whether based on tobacco, tobacco derivatives, expanded tobacco, reconstituted tobacco or tobacco substitutes and also heat-not-burn products.

Figure 1:
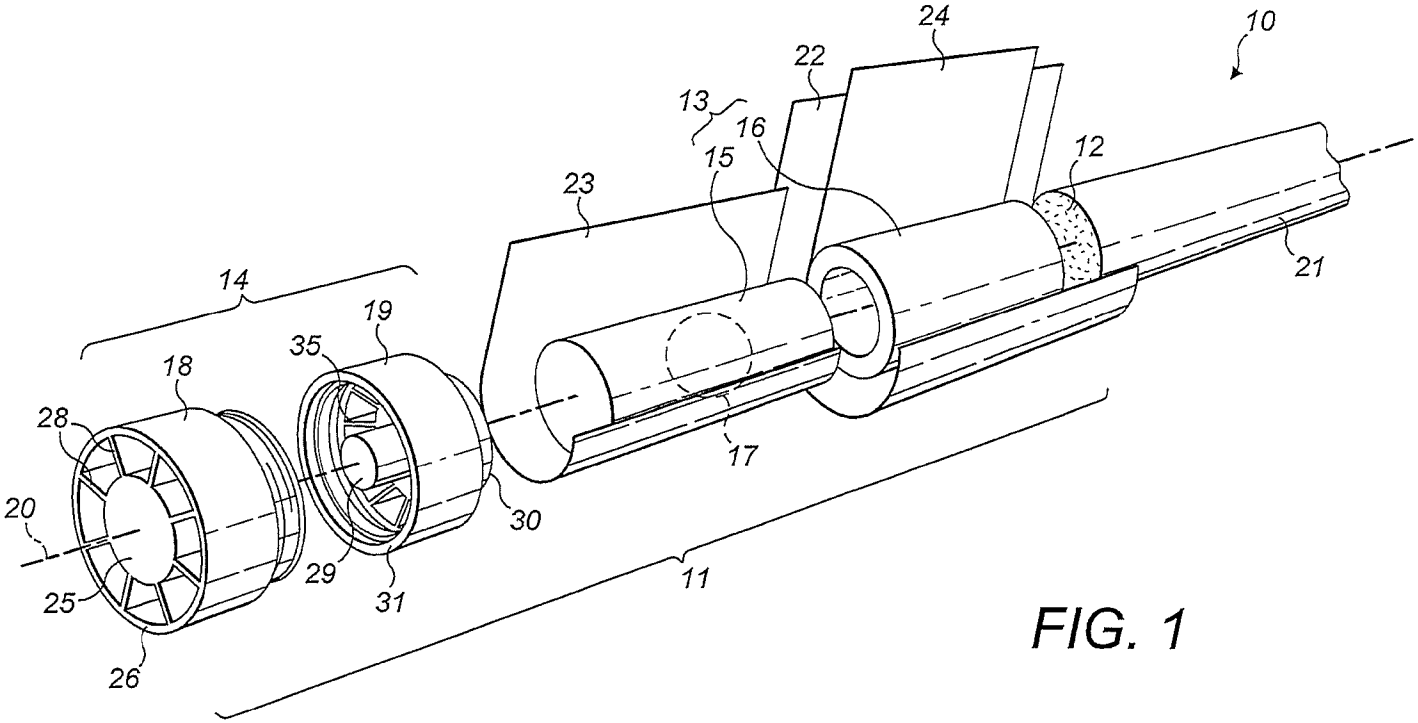
FIG. 1 is an exploded perspective view of a smoking article including a filter element comprising a flow control device.
Figure 2:
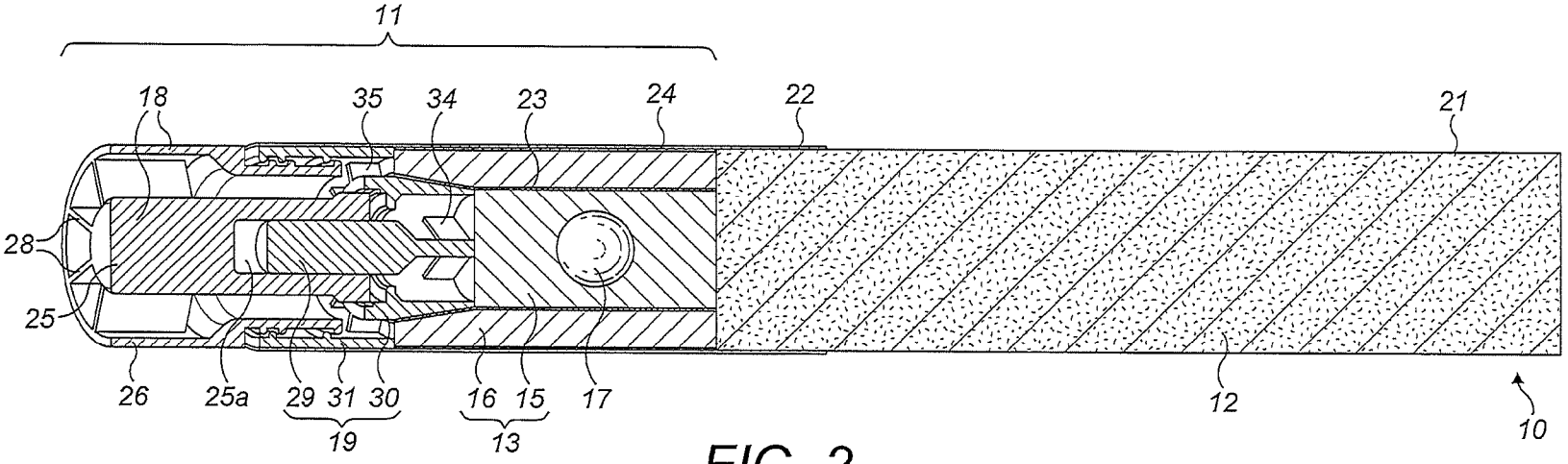
FIG. 2 is a sectional view of the smoking article of FIG. 1.

FIGS. 1 and 2 show a smoking article 10 including a filter element 11 comprising a flow control device.

The smoking article 10 includes a source of smokeable material, which preferably comprises tobacco, in the form of a cylindrical tobacco rod 12. The tobacco rod 12 is in axial alignment with, and is connected to, the filter element 11.

The filter element 11 comprises a main filter part 13 and a selector 14.

The main filter part 13 includes an inner filter part 15 and an outer filter part 16, which respectively define an inner flow path and an outer flow path through the filter element 11. The inner filter part 15 includes an additive release component 17 for selective release of a smoke modifying agent, which may be an encapsulated smoke modifying agent such as a flavourant (e.g. menthol). In the embodiment shown, the additive release component comprises a frangible spherical capsule 17 comprising a menthol flavourant.

The selector 14 includes a first selector piece 18 at its end furthest from the tobacco rod 12 and a second selector piece 19 at its end nearest to the tobacco rod 12.

As will be described in more detail below, the second selector piece 19 is attached to the main filter part 13, and the first selector piece 18 is moveably attached to the second selector piece 19. The tobacco rod 12, main filter part 13, and first and second selector pieces 18, 19 are generally cylindrical, have a similar outer diameter, and are arranged co-axially, thereby defining an axis 20.

The first selector piece 18 is movable relative to the second selector piece 19 in order to close the inner flow path defined by the inner filter part 15, or to select one or more different degrees of opening of the inner flow path. For example, in the embodiment shown, the inner flow path may be completely closed, or may be open to a small extent (a "low" setting), a greater extent (a "medium" setting), or may be fully open (a "high" setting). In contrast, the outer flow path is always open. The outer flow path is not, therefore, "controllable" because it cannot be directly controlled (even though the level of flow through this path may in some circumstances be altered in response to the setting of the inner flow path).

A paper wrapper 21 is wrapped around the tobacco rod 12. A tipping paper 22 is wrapped around and thereby combines a length of the tobacco rod 12, the main filter part 13 and the second selector piece 19.

The relative axial positions of various features are described hereinafter as if the smoking article 10 is orientated with the tobacco rod 12 at the far end of the filter element 11, and the words "near" and "far", and related words, are to be understood accordingly. This is merely for convenience, and it will be appreciated that the smoking article 10 can be orientated in any way.

Referring in particular to FIGS. 1 and 2, the main filter part 13 will now be described in more detail.

The inner and outer filter parts 15, 16 each include filtration material, which in the example shown in FIGS. 1 and 2 comprises cellulose acetate tow. In general, any material which is capable of filtering tobacco smoke may be used. The filtration material used in each of the different filter parts 15, 16 may differ, or may be the same.

The additive release component 17 is adapted to selectively release the smoke modifying agent and, in particular, to break or rupture in response to force, such as compressive force, applied to the filter element 11. In the embodiment shown, the additive release component 17 is a spherical capsule comprising a menthol flavourant. The term "release" is intended to include any means of exposure of the smoke modifying agent to the smoke that is drawn, in use, through the inner filter part 15, in addition to physical release and movement of the smoke modifying agent out of the encapsulation. Prior to its release, the additive is in an inactive state and does not affect the smoke. Once released, the additive is active and can modify the smoke that is drawn through the smoking article 10 when the smoking article is in use.

The inner and outer filter parts 15, 16 are coaxially arranged, with the annular outer filter part 16 arranged around the inner filter part 15. The inner filter part 15 has a solid cylindrical shape. The outer filter part 16 has a hollow cylindrical tube shape. The inner diameter of the outer filter part 16 is substantially the same as the (outer) diameter of the inner filter part 15. The outer diameter of the outer filter part 16 is substantially the same as the outer diameter of the tobacco rod 12. In this example, the outer filter part 16 has a diameter of around 7.8 mm and the inner filter part 15 has a diameter of around 5.35 mm. However, the inner and outer filter parts 15, 16 may have any suitable diameters and/or cross-sectional areas as appropriate.

A barrier layer 23 of non-porous material is provided around the inner filter part 15, that is to say between the inner and outer filter parts 15, 16. The barrier layer 23 also circumscribes part of the second selector piece 19 as shown in FIG. 2. The barrier layer 23 may be formed of a non-porous polymer such as a film, for example, comprising cellulose diacetate. The barrier layer 23 is adapted to prevent flow or diffusion of smoke or flavourant from the inner to the outer filter parts 15, 16 and vice versa. This can assist in preventing the migration of flavour or other smoke modifying additives between the inner and outer filter parts 15, 16, for instance. An additional inner plug wrap (not shown), which may be porous or non-porous, may also be provided around the inner filter part 15.

An outer plug wrap 24 is provided around the outer filter part 16. The outer plug wrap 24 may be porous or non-porous.

Figure 3:
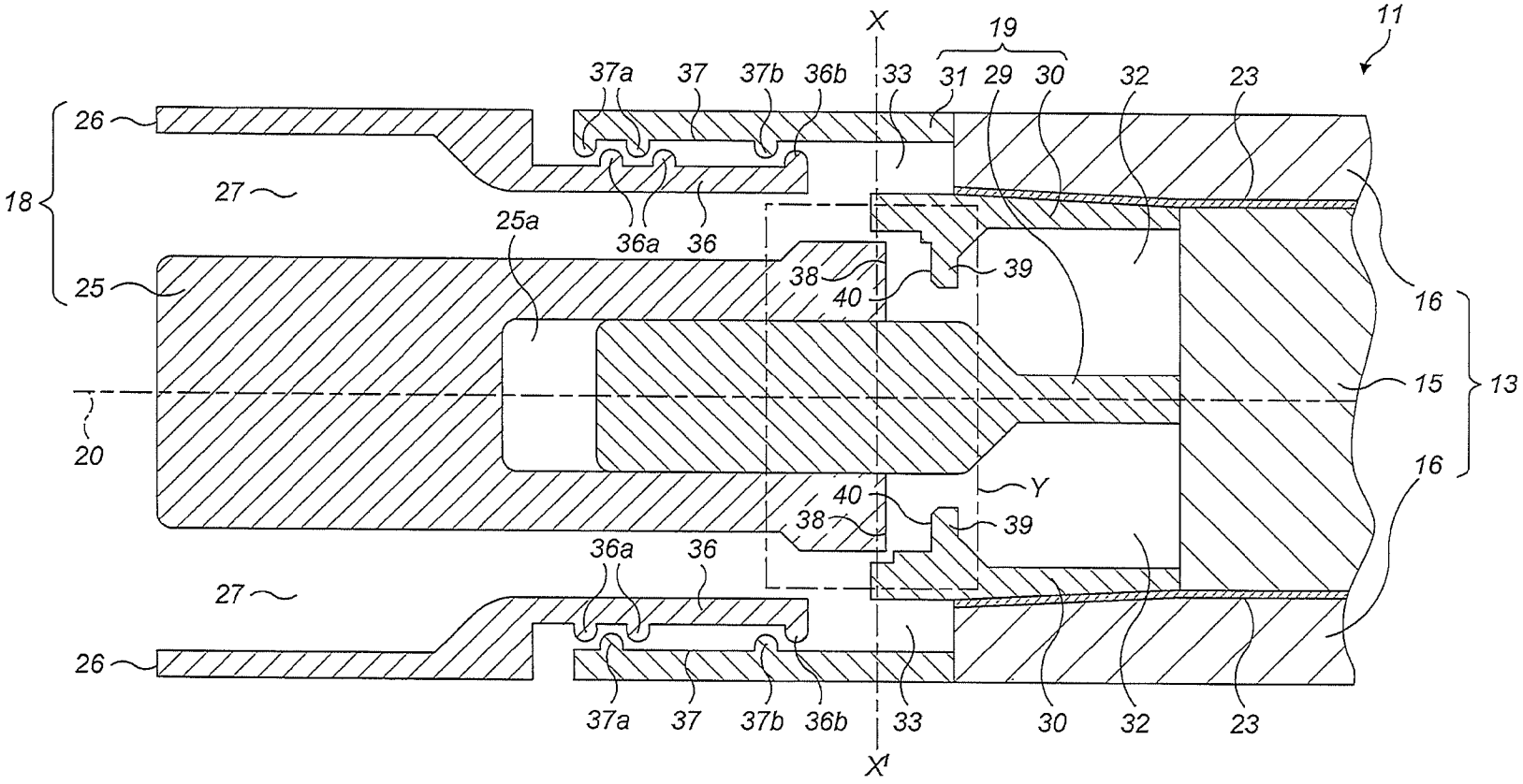
FIG. 3 is a diagram of part of the filter element of FIG. 1.

Referring in particular to FIG. 3, the first and second selector pieces 18, 19 will now be described in more detail.

The first and second selector pieces 18, 19 may be made of any suitable material, such as a plastic material and, in particular, they may be moulded from a thermoplastic such as high density polyethylene.

The first selector piece 18 includes an inner part 25 and an outer, hollow tube part 26 (hereinafter referred to as a "first inner part" and "first outer part" respectively). The first inner part 25 comprises a central recess 25*a*. The first inner part 25 and the first outer part 26 are generally cylindrical and coaxial.

An annular space 27 (hereinafter referred to as a "first space") between the first inner part and the first outer part 25, 26 defines a flow path through the first selector piece 18.

A plurality of members 28 (hereinafter referred to as "first spokes") at the end of the first selector piece 18 connect the first inner part 25 to the first outer part 26. The first space 27 comprises the gaps between the first spokes 28. In use, flow may be drawn through the first selector piece 18 between the first spokes 28.

Figure 4A:
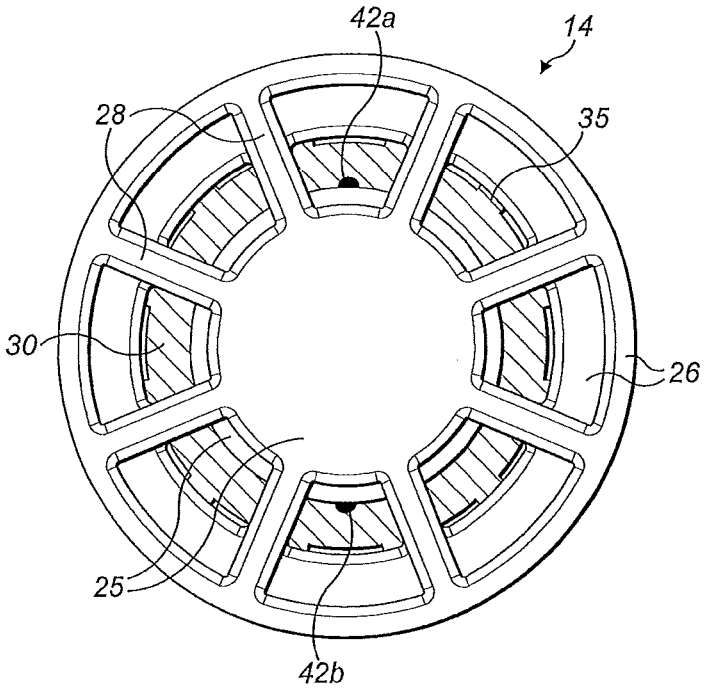
FIG. 4A is a first ("near") end view of the selector of the flow control device shown in FIG. 1.

In the embodiment shown, the first spokes 28 each extend in a generally radial direction. FIG. 4A shows the selector 14, viewed from the near (mouth) end. As shown in FIG. 4A, the first spokes 28 are distributed substantially evenly around the circumference of the first inner part 25. The first spokes 28 each have a rectangular cross-section which is elongated in a direction parallel to the axis 20. Generally the first spokes 28 function to connect and support the first inner part 25 and the first outer part 26, while allowing flow to be drawn between the two parts 25, 26. The first spokes 28 may have any suitable configuration accordingly. For example, in some embodiments, the first spokes 28 may be non-radial, and may be, for example, arranged in a spiral configuration. In some embodiments, the first spokes 28 may extend non-linearly between the first inner and first outer parts 25, 26, and may, for example, be curved.

In the embodiment shown, the first spokes 28 stop short of the far end of the first space 27 (see FIG. 2).

Referring again to FIG. 3 in particular, the second selector piece 19 includes an inner part 29, an intermediate, hollow tube part 30, and an outer, hollow tube part 31 (hereinafter referred to as a "second inner part", a "second intermediate part" and a "second outer part" respectively). The second inner part 29, second intermediate part 30, and the second outer part 31 are generally cylindrical and coaxial.

The second intermediate part 30 divides the second selector piece 19 into an inner annular space 32 and an outer annular space 33 (hereinafter referred to as a "second inner space" and "second outer space" respectively). The second inner space 32 and the second outer space 33 define respective inner and outer flow paths through the second selector piece 19.

Figure 4B:
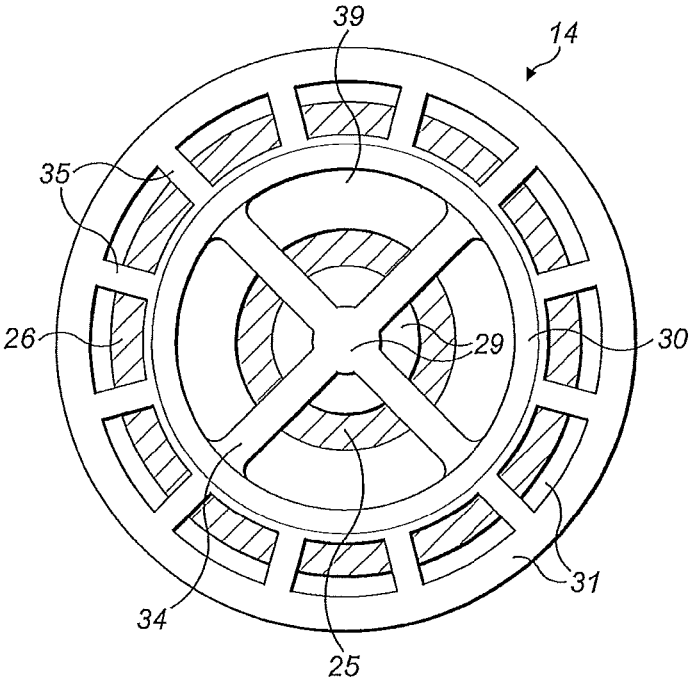
FIG. 4B is a second ("far") end view of the selector of the flow control device shown in is FIG. 1.

As shown in FIG. 4B, the second inner part 29 is connected to the second intermediate part 30 by a plurality of inner spokes 34 (hereinafter referred to as "second inner spokes"). The second intermediate part 30 is connected to the second outer part 31 by a plurality of outer spokes 35 (hereinafter referred to as "second outer spokes"). The second inner spokes 34 and the second outer spokes 35 connect the relevant parts of the second selector piece together while allowing flow to be drawn through the second selector piece 19 in the axial direction via the second inner space 32 (in the case of the second inner spokes 34), or via the second outer space 33 (in the case of the second outer spokes 35). The spokes 34, 35 may have any suitable configuration accordingly.

Referring again to FIG. 3, the connection between the second selector piece 19 and the main filter part 13 will now be described.

The inner filter part 15 is shorter than the outer filter part 16, forming a cylindrical recess in the main filter part 13 at its near end. The barrier layer 23 is coextensive with the inner surface of the outer filter part 16. The second intermediate part 30, which protrudes from the second selector piece 19 is received in the recess in the main filter part 13. The second intermediate part 30 of the second selector piece 19 has a tapered (conical) section at its far end. The taper is such that, at the far end of the taper, the second intermediate part 30 is substantially equal to the width (when un-deformed) of the cylindrical recess in the main filter part 13 and, at the near end of the taper, it is wider. Thus, when assembled (as shown, for example, in FIG. 3), the outer filter part 16 is deformed by, and engages strongly with, the second intermediate part 30. By means of this arrangement, the second selector piece 19 and the main filter part 13 are attached together. A suitable adhesive may be also used. This arrangement also forms a seal for preventing smoke modifying agent from passing between the inner and outer flow paths. Moreover, the arrangement makes it easier to assemble the filter element 11 and reduces the risk of damage to the barrier layer 23 during assembly.

By means of this arrangement, the inner flow path defined by the inner filter part 15 is in fluid communication with the inner flow path defined by the second inner space 32 in the second selector piece 19. The outer flow path defined by the outer filter part 16 is in fluid communication with the outer flow path defined by the second outer space 33 in the second selector piece 19. Thus, the inner and outer flow paths are separated by the barrier layer 23 and the second intermediate part 30.

Referring still to FIG. 3, the connection between the first and second selector pieces 18, 19 will now be described.

The first and second selector pieces 18, 19 are connected to each other by way of a screw-threaded connection. In particular, a cylindrical recess 36 provided in the outer surface at the far end of the first outer part 26 cooperates with the internal surface 37 of the second outer part 31. The external surface of the cylindrical recess 36 comprises a first thread 36*a*. The internal surface 37 of the second outer part 31 comprises a second thread 37*a*, which co-operates with the first thread 36*a*. In this way, the smoker can control the relative axial position of the first and second selector pieces 18, 19 by rotating one in relation to the other.

In the embodiment shown, a first collar 36*b* at the far end of the cylindrical recess 36, and a second collar 37*b* on the internal surface 37 of the second outer part 31 interact to limit the extent to which the first and second selector pieces 18, 19 may be unscrewed.

The first and second selector pieces 18, 19 may include co-operating parts (not shown) for indexing the rotation and hence the relative axial position of the two selector pieces 18, 19. For example, the first collar 36*b* may comprise one or more notches which may engage with one or more raised elements on the internal surface 37 of the second outer part 31, which may provide tactile and/or audible feedback to the user.

The outer parts 26, 31 of the first and second selector pieces 18, 19 interact with each other so as to form a seal. This seal is to reduce or prevent flow between the flow paths inside the selector 14 and the exterior of the smoking article 10.

Referring still to FIG. 3, and also to FIG. 5, the elements of the first and second selector pieces 18, 19 which cooperate in order to control flow will now be described.

The first inner part 25 of the first selector piece 18 and the second intermediate part 30 of the second selector piece 19 are adapted so that they can co-operate with each other to control the extent to which flow may be drawn along the inner flow path. In particular, a portion of the far end of the first inner part 25 fits between the second intermediate part 30 and second inner part 29, and together these parts form a plurality of discrete controllable flow channels through which flow may be drawn from the second inner space 32 into the first space 27. Each of the controllable flow channels may be open or closed depending upon the relative position of the first and second selector pieces 18, 19. The level of flow that may be drawn along the inner flow path is dependent on the number of controllable flow channels that are open. Thus, the extent to which flow may be drawn along the inner flow path is dependent upon the relative axial position of the first and second selector pieces 18, 19. The inner flow path may be closed, or may be in one of a number of discrete open states, each different open state corresponding to a position in which a different number of controllable flow channels are open. In the embodiment shown, the inner flow path may be closed, or may be in one of three different open states, representing a "low" setting, a "medium" setting, and a "high" setting.

The first inner part 25 includes a flat annular surface 38 (hereinafter referred to as a "first end surface") at its far end.

The second intermediate part 30 includes a collar 39 extending inwards from its inner surface. The collar 39 has a flat annular surface 40 (hereinafter referred to as a "second end surface") at its near end.

Figure 6D:
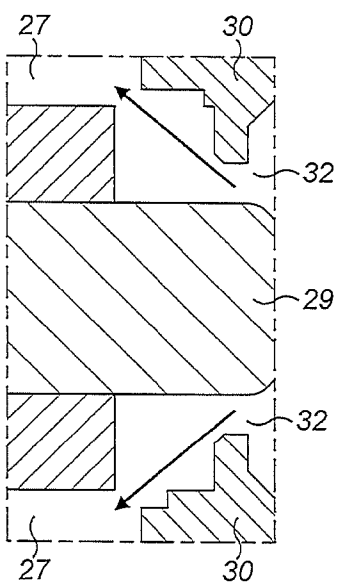
FIGS. 6A, 6B, 6C, and 6D are diagrams of the region indicated in box Y on FIG. 3, showing the selector of the flow control device in different positions. In particular.
Figure 6C:
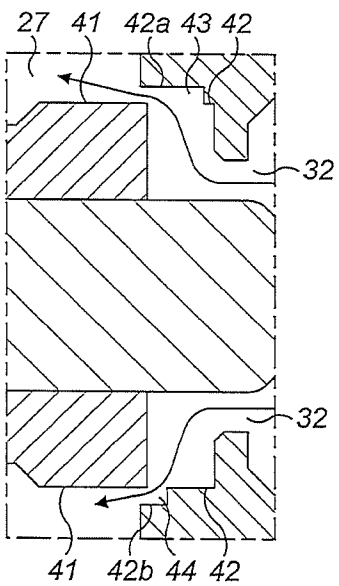
Figure 6B:
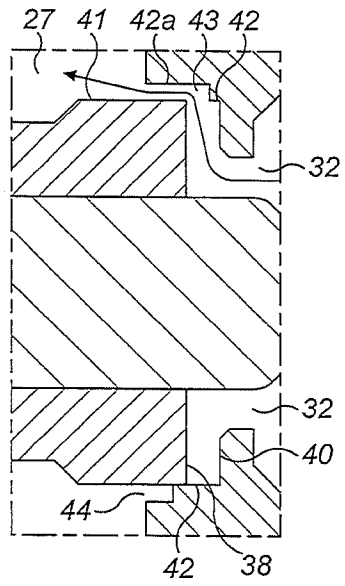
Figure 6A:
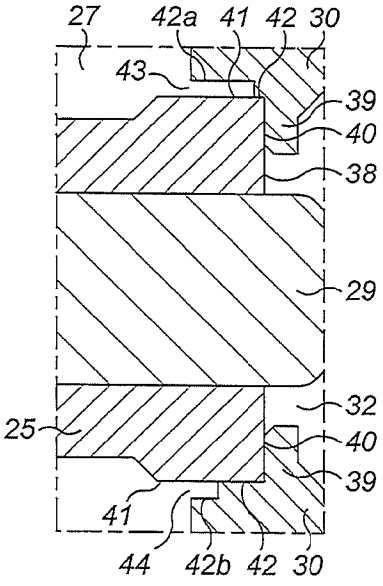

FIGS. 6A-D are diagrams showing the region indicated in box Y on FIG. 3. FIG. 6A shows the first and second selector pieces 18, 19 in a first relative position, hereinafter referred to as the "closed position", wherein no flow may be drawn along the inner flow path. In the closed position, the first end surface 38 contacts the second end surface 40 so as to prevent the passage of flow between these two surfaces. Thus, there can be no flow from the inner flow path of the second selector piece 19 into the first space 27 in the first selector piece 18 (or vice versa). The closed position corresponds to the maximum extent to which the first selector piece 18 can be moved axially towards the second selector piece 19.

The first inner part 25 includes an outer cylindrical surface region 41 (hereinafter referred to as a "first cylindrical surface") adjacent to its far end.

The second intermediate part 30 includes an inner cylindrical surface region 42 (hereinafter referred to as a "second cylindrical surface") adjacent to its near end. In the embodiment shown, the first and second cylindrical surfaces 41, 42 substantially contact each other in such a way as to allow slidable movement while preventing substantially any flow to be drawn between them, except in the controllable flow channels 43, 44 which will be described below. This applies in all of the relative axial positions of the first and second selector pieces 18, 19, wherein, in each different relative axial position, the first inner part 25 extends a different distance into the second intermediate part 30 and different portions of the first and second cylindrical surfaces 4, 42 contact each other. The first and second cylindrical surfaces 41, 42 are in contact to a greater or lesser extent in all relative positions of the first and second selector pieces 18, 19. In other embodiments, the first and second cylindrical surfaces 41, 42 may be separated by a narrow annular space, which may assist movement of the two cylindrical surfaces 41, 42, while allowing only a minimal amount of flow to be drawn between the two surfaces.

Figure 5:
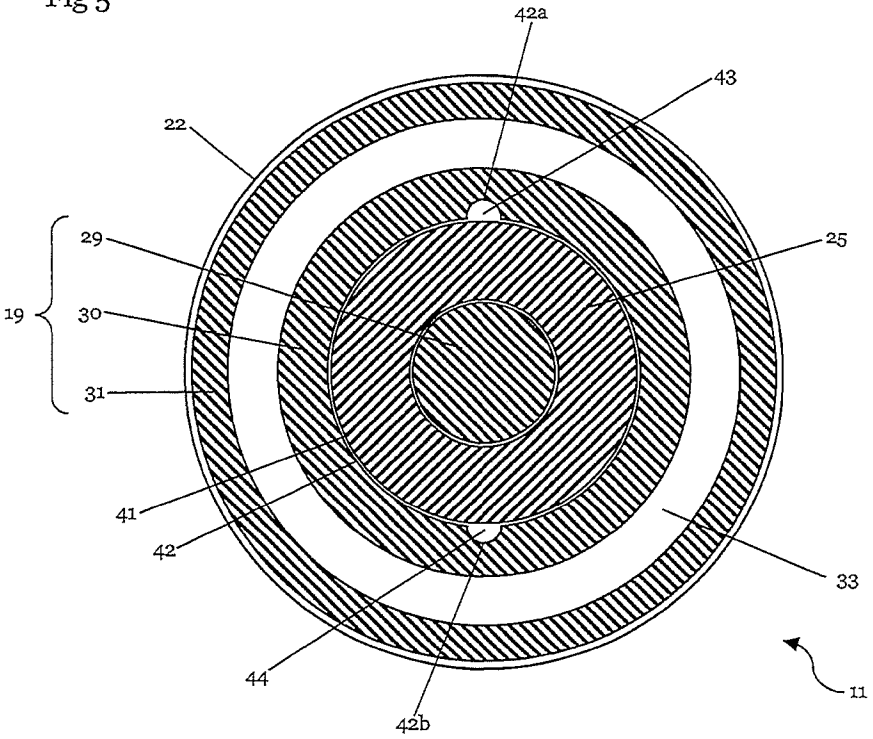
FIG. 5 is a transverse cross-sectional view of the filter element of FIG. 1 along the line X-X' marked in FIG. 3.

As shown in FIGS. 5 and 6A in particular, the second cylindrical surface 42 includes first and second grooves 42*a*, 42*b*. The first and second grooves 42*a*, 42*b* define respective first and second controllable flow channels 43, 44, for flow between the first and second cylindrical surfaces 41, 42. Each groove 42*a*, 42*b* has an approximately semicircular cross-section. The first and second grooves 42*a*, 42*b* are spaced from each other around the second cylindrical surface 42 and, in the embodiment shown, they are positioned diametrically opposite each other (see FIG. 5). In other embodiments, the second cylindrical surface 42 includes more than two grooves, and in this case, the more than two grooves may be positioned such that they are evenly or unevenly spaced around the second cylindrical surface. In other embodiments, there may be only one groove, or more than two grooves, such as three, four, five, six, seven, or eight grooves.

As shown in FIG. 6A, each groove 42*a*, 42*b* extends from the near end of the second intermediate part 30 towards the far end. The first and second grooves 42*a*, 42*b* have different lengths. The first groove 42*a* is longer than the second groove 42*b*. The first groove 42*a* extends to within an axial distance of about 0.1 mm from the second end surface 40. The second groove 42*b* extends to within an axial distance of about 0.3 mm from the second end surface 40.

As shown in FIG. 6A, when the first and second selector pieces 18, 19 are in the closed position, or when the relative position of the first and second selector pieces 18, 19 is less than 0.1 mm from the closed position, the first and second grooves 42*a*, 42*b* in the second cylindrical surface 42 are substantially sealed by the first cylindrical surface 41. Hence the first and second controllable flow channels 43, 44 are closed and substantially no flow may be drawn from the second inner space 32 of the second selector piece 19 into the first space 27 of the first selector piece 18.

In FIG. 6B, the relative axial position of the first and second selector pieces 18, 19 is such that the gap between the first and second end surfaces 38, 40 is more than 0.1 mm and less than 0.3 mm. In this case, the second groove 42*b* is completely sealed by the first cylindrical surface 41. However, the first groove 42*a* is not completely sealed by the first cylindrical surface 41. The first controllable flow channel 43 is in fluid communication with the second inner space 32. Hence, in this first open position, the second controllable flow channel 44 is substantially closed while the first controllable flow channel 43 is open. Flow can thereby be drawn between the second inner space 32 of the second selector piece 19 and the first space 27 in the first selector piece 18. Substantially all of this flow is via the first controllable flow channel 43.

The resistance to flow through the first controllable flow channel 43 depends, in part, on the cross-sectional area of the first controllable flow channel 43. The resistance to flow also depends on the length of the first controllable flow channel 43, that is to say the length of the first groove 42*a* covered by the first cylindrical surface 41.

As described above, the relative axial positions of the first and second selector pails 18, 19 may be indexed, for example by means of one or more notches in the first collar 36*b*, which may engage with one or more raised elements on the internal surface 37 of the second outer part 31. The indexing may be such that there is a first index position wherein the first controllable flow channel 43 has a predetermined length. For example, in the first index position, the relative position of the first and second selector pieces 18, 19 may be 0.2 mm from the closed position. Such a relative position of the first and second selector pieces 18, 19, as shown in FIG. 6B, in which flow may be drawn through the first controllable flow channel 43, but not substantially through the second controllable flow channel 44, is referred to hereinafter as a "first open position".

In FIG. 6C, the relative position of the first and second selector pieces 18, 19 is more than 0.3 mm from the closed position. When the first and second selector pieces 18, 19 are in this relative position, neither the first groove 42*a*, nor the second groove 42*b*, is completely covered by the first cylindrical surface 41. The portions of the first and second grooves 42*a*, 42*b* which are not covered by the first cylindrical surface 41 are in fluid communication with the second inner space 32 of the second selector piece 19. Hence, both the first and second controllable flow channels 43, 44 are open. Flow can thereby be drawn between the second inner space 32 of the second selector piece 19 and the first space 27 in the first selector piece 18. Substantially all of this flow is via the first and second controllable flow channels 43, 44.

The resistance to flow through the first and second controllable flow channels 43, 44 depends, in part, on the cross-sectional areas of the first and second controllable flow channels 43, 44. The resistance to flow also depends on the lengths of the first and second controllable flow channels 43, 44, that is to say the respective lengths of the first and second grooves 42*a*, 42*b* covered by the first cylindrical surface 41.

As described above, the relative axial positions of the first and second selector pieces 18, 19 may be indexed. The indexing may be such that there is a second index position wherein the first and second controllable flow channels 43, 44 have predetermined lengths. For example, in the second index position, the relative position of the first and second selector pieces 18, 19 may be 0.4 mm from the closed position. Such a relative position of the first and second selector pieces 18, 19, as shown in FIG. 6C, in which flow may be drawn through both the first and second controllable flow channels 43, 44, is referred to hereinafter as a "second open position".

In embodiments in which there are more than two grooves 42*a*, 42*b*, there may be correspondingly more than two open positions.

In FIG. 6D, the first and second selector pieces 18, 19 are in a maximally open position, which corresponds to the maximum extent to which the first selector piece 18 can be moved axially away from the second selector piece 19. The axial displacement of the first and second selector pieces 18, 19, is limited by contact between the first collar 36*b* and the second collar 37b. In this relative position of the first and second selector pieces 18, 19, the first inner part 25 is fully withdrawn from the second intermediate pall 30. The second inner space 32 of the second selector piece 19 is therefore in direct fluid communication with the first space 27 in the first selector piece 18. By way of example, in the third index position, the relative position of the first and second selector pieces 18, 19 may be 0.6 mm from the closed position.

Thus, in the embodiment shown, in the closed position, neither of the controllable flow channels 43, 44 are open, and thus substantially no flow can be drawn from the second inner space 32 to the first space 27. In the closed position, the pressure drop may be greater than about 2000 mmWG.

In the first open position, the second controllable flow channel 44 is closed, but the first controllable flow channel 43 is open and provides a route for flow to be drawn from the second inner space 32 to the first space 27. In the first open position, which represents a "low" setting, the pressure drop may be about 700-900 mmWG.

In the second open position, both the first and second controllable flow channels 43, 44 are open. Thus, flow may be drawn from the second inner space 32 to the first space 27 via both channels. In the second open position, which represents a "medium" setting, the pressure drop may be about 150-250 mmWG.

Finally, in the third open position, the first inner part 25 is fully withdrawn from the is second intermediate part 3o and flow may be drawn directly from the second inner space 32 to the first space 27. In the third open position, which represents a "high" setting, the pressure drop may be less than about 20 mmWG.

By means of the selector 14, when the smoking article is in use, the smoker can manipulate the filter element 11 to control the properties of the smoke provided by the smoking article.

Referring back to FIGS. 1 and 2, in the embodiment shown, the filter element 11 comprises an additive release component 17 in the form of a capsule. The capsule 17 contains a flavourant. In other embodiments, the capsule may contain, in addition, or as an alternative to a flavourant, another smoke modifying agent. Prior to or during use of the smoking article 10 the smoker can apply force to, and thus deform, the filter element 11 and the capsule 17. The application of force causes the capsule 17 to rupture and release the flavourant. Once the capsule has been ruptured, the flavourant may become entrained in smoke which is drawn along the inner flow path through the filter element 11.

The smoking article 10 may, for example, be supplied with the first and second selector pieces 18, 19 in the closed position. In this position, smoke can only flow in the outer flow path, in particular through the outer filter part 16 and second outer space 33. Since no smoke can be drawn through the inner flow path when the first and second selector pieces 18, 19 are in the closed position, the smoke which is drawn through the filter element 11 under these conditions will be unflavoured.

In some embodiments, the smoking article may be an inherently flavoured smoking article, such as a menthol smoking article. In this case, the additive release component 17 may comprise a menthol flavourant, and the selector 14 may be used to provide an increased level of flavour (a "boost") above the background level.

The user can rotate the first selector piece 18 relative to the second selector piece 19 and the remainder of the smoking article 10. Thus, the selector 14 detailed in FIG. 6 can be moved, for example, between the closed position, a first open position (corresponding to a "low" level of flavour), a second open position (corresponding to a "medium" level of flavour), and a third open position (corresponding to a "high" level of flavour). As described above, when the first and second selector pieces 18, 19 are in any is of the open positions, smoke can be drawn through the inner flow path. The smoke which is drawn through the filter element 11 will thus be flavoured if the selector 14 is in an open position.

Figure 7A:
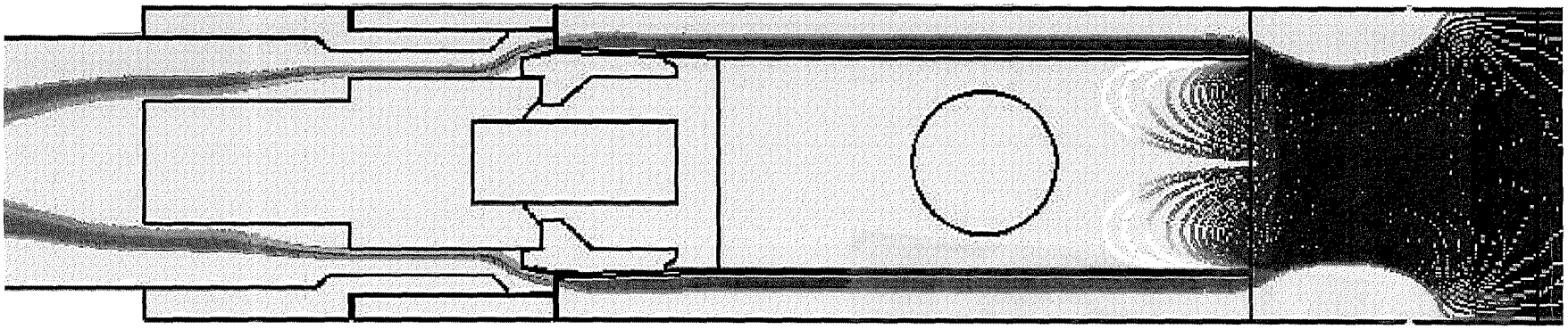
FIGS. 7A and 7B are diagrams showing the residence time of smoke drawn through the filter element of FIG. 1. In particular.
Figure 7B:
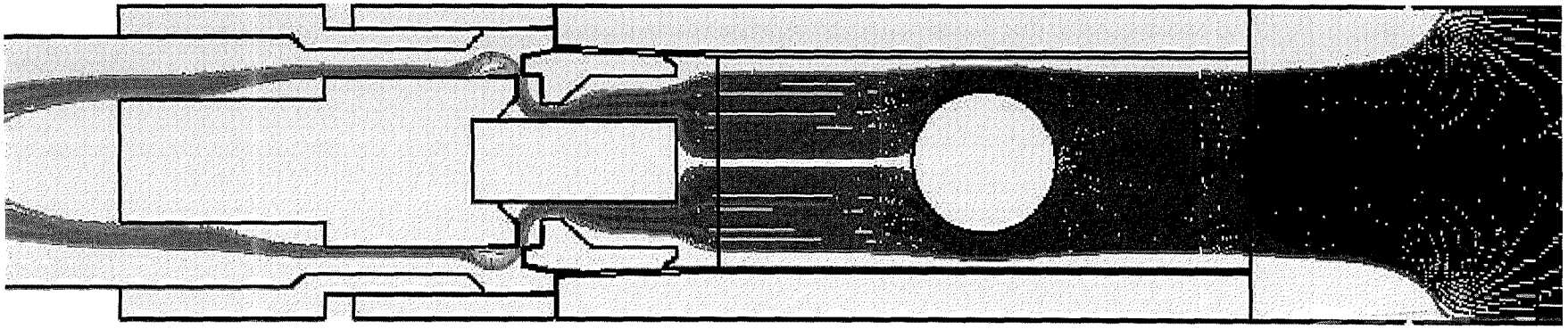

FIGS. 7A and 7B are diagrams showing the residence time of smoke drawn through the filter element of FIG. 1. FIG. 7A shows the residence time of smoke when the smoking article is in use in the closed position, and in FIG. 7B the smoking article is in use in the third open position (the "high" setting). It can be seen from FIG. 7A that there is no flow along the inner flow path, and all of the smoke is drawn along the outer annular flow path. In contrast, as shown in FIG. 7B, when the selector is in the high setting, substantially all of the flow is drawn along the inner flow path and there is little or no flow drawn along the outer flow path.

The extent to which the smoke is flavoured is dependent upon the proportion of the smoke that is drawn via the inner flow path through the filter element 11. Thus, the first open position corresponds with the provision to the user of relatively more weakly flavoured smoke, the second open position corresponds with the provision to the user of smoke having an intermediate level of flavour, and the third open position corresponds with the provision to the user of maximally flavoured smoke.

Hence, by adjusting the selector 14, the user can adjust the amount of flavourant entrained in the smoke.

Regardless of the relative position of the first and second selector pieces 18, 19, smoke can be drawn through the outer flow path, that is to say, the outer filter part 16 and the second outer space 33 of the second selector piece 19, and the first space 27 of the first selector piece 18. Thus, the outer flow path cannot be considered to be a controllable flow path or controllable flow channel. The outer flow path cannot be considered controllable because it comprises filter part 16 and spaces 33 and 27, and none of these features can be manipulated in any way by the user to control the level of flow through the flow path. Thus, the outer flow path is not controllable because it cannot be directly controlled, even though the level of flow along the outer flow path may, under some circumstances, be adjusted as an indirect consequence of the adjustment of a controllable flow channel.

The filter element 11, and the selector 14, may be manufactured by any suitable method, and from any suitable material. Plastic materials are generally preferred for manufacture of the parts of the selector 14 and, in particular, they may be moulded from a thermoplastic such as high density polyethylene.

In some embodiments, the first and second selector pieces 18, 19, may be moulded and then fitted together within the mould tool.

In some embodiments, one or both of the first and/or second selector pieces 18, 19, may comprise means for locating the part during the manufacturing process. For example, one or more of the first spokes 28, the second inner spokes 34, and/or the second outer spokes 35, may comprise a unique spoke, for example comprising a protrusion, which may function as a locator.

Previous flow control devices have proven to be very sensitive to misalignment or changes in size of the moulded parts during the manufacturing process, which has resulted in significant variation between devices, and consequently increased wastage costs and/or reduced satisfaction for the user.

In contrast, the present flow control device offers surprising manufacturing advantages. In particular, because the amount of flow that can be drawn through the device depends not on the precise cross-sectional area of the flow path, but simply on the number of controllable flow channels 43, 44 that are open, the manufacturing process can be controlled in a highly accurate and reproducible manner.

In particular, the grooves 42*a*, 42*b* can be defined in the mould tool by core pins which mean that they can be held to a very tight manufacturing tolerance.

The improved accuracy of manufacture leads to further advantages in terms of cycle time, reduced wastage and thus part cost.

It will be appreciated that many modifications may be made to the embodiment shown in FIGS. 1 to 6. Each of these modifications, and others that are not explicitly described but will be obvious to the skilled person, may be used individually or in combination with any of the other modifications where technically feasible.

Amongst other things, the selector 14 may be differently configured.

For example, the selector 14 need not include the collar 39 or the first and second end surfaces 38, 40. In this case, the prevention or reduction of flow through the inner flow path can be achieved merely by the movement of the first and second selector pieces 18, 19 into relative axial positions in which the controllable flow channels 43, 44 are closed by the first and second cylindrical surfaces 41, 42.

The first and second end surfaces 38, 40 may be differently configured. The first and second end surfaces 38, 40 need not face in the axial direction. In addition, or as an alternative, the first and second end surfaces 38, 40 may be conically shaped, or may have any other shape or configuration in which the two surfaces are capable of interacting to substantially prevent the passage of smoke. Additional or alternative closures and/or seals may also be included.

As briefly mentioned above, the number of controllable flow channels 43, 44 may differ from the two channels shown in the embodiment of FIGS. 1 to 6.

For example, there may be only one controllable flow channel. In this case, the selector 14 may have three main states, namely a closed state, an intermediate open state in which the controllable flow channel is open, and a maximally open state, in which the first inner part 25 is fully withdrawn from the second intermediate part 30.

Alternatively, there may be three or more controllable flow channels, such as four, five, six, seven, or eight controllable flow channels, for example. The number of controllable flow channels may in some cases be limited by the desire to provide smoke having a discernibly different flavour in each position of the selector 14. The number of discernable different states and hence the number of controllable flow channels in the selector 14 may differ for different flavourants.

In the case of three or more controllable flow channels, there may be four or more open positions, each different open position corresponding to a different number of open controllable flow channels.

Alternatively, two or more of the controllable flow channels may have the same length and so may be in the same open or closed state at the same relative position of the first and second selector pieces 18, 19. In this case, the number of open positions will be equal to or smaller than the number of controllable flow channels.

In the embodiment shown, the first and second cylindrical surfaces 41, 42 are substantially in contact with each other. In other embodiments, however, the first and second cylindrical surfaces 41, 42 may not be in contact with one another, such that a degree of flow may be drawn between the two surfaces, in addition to within the one or more channels 44.

One or more of the grooves 42*a*, 42*b* may have different cross-sectional areas and/or shapes from other grooves. For example, a first groove may have a larger cross-sectional area than a second groove. In this case, the relative change in smoke modification between the first and second open positions may be larger than the case in which the grooves have the same cross-sectional area.

Instead of a uniform, semicircular cross section, the grooves 42*a*, 42*b* may have a non-uniform and/or a differently shaped, for example, square, cross section.

The grooves 42*a*, 42*b* may be tapered such that the cross-sectional area of one or more of the grooves may vary along its length.

Instead of extending in only the axial direction, the grooves 42*a*, 42*b* may extend in a different direction or different directions. Thus, the controllable flow channels formed by different grooves may have different lengths.

The first and second selector pieces 18, 19 may be adapted to move relative to each other in a different way, for example only axially or only rotationally.

If the movement is only rotational, then the first cylindrical surface 41 may be adapted so that controllable flow channels 43, 44 can be opened or closed in response to the movement. In addition, one or both of the first and second cylindrical surfaces 41, 42 may have circumferential modifications to the surface to aid rotation, such as castellation, grooves, and/or ridges. For example, in some embodiments, the first and second selector pieces 18, 19 may lack screw threads 36*a*, 37*a*, and may simply be rotationally interlocked.

The first and second cylindrical surfaces 41, 42 need not be cylindrical and may, for example, be formed on one or more surfaces of non-cylindrical parts such as parts with square or rectangular cross sections. The parts whose surfaces interact to open or close the controllable flow channels 43, 44 (which, in the embodiment shown in FIGS. 1-6, are the first inner part 25 and the second intermediate part 30) need not fit one inside the other and, for example, may be arranged one alongside the other.

In the embodiment shown in FIGS. 1 to 6, a smoke modifying agent in the form of a flavourant is included in the inner flow path in the main filter part 13. Alternatively or additionally, the smoke modifying agent can be included in the outer flow path.

The filter part 13 may include smoke modifying agent in both of the inner and outer flow paths. One of the flow paths may contain one smoke modifying agent, and the other flow path may contain another, similar or different smoke modifying agent.

One flow path may include more than one different smoke modifying agent, contained within the same or different additive release components.

Alternatively, a smoke modifying agent is not present in either of the flow paths, and instead the flow paths may have different characteristics relating to, for example, the type of filtration of the smoke, the pressure drop, and/or the amount of ventilating air which is introduced.

Instead of being for the flow of smoke, one or both of the flow paths may be flow paths for the flow of smoke modifying agent only, ventilating air only, or smoke modifying agent and ventilating air only. These flow paths need not pass through a filter part that includes filtration material.

There may be a different number of flow paths. For example, the second selector piece 19 need not have an outer flow path therethrough and may include only one flow path comprising a plurality of controllable flow channels, wherein the overall level of flow is controlled by means of the selector 14.

There may be three or more flow paths through the filter element 11 and/or the second selector piece 19. In this case, the selector 14 may be adapted to control flow through one, more than one, or all of the flow paths.

The selector 14 may be any selecting means for allowing flow selectively through the first and second flow paths.

The second selector piece 19 may be connected to the first selector piece 18.

Elements described as being associated with the first selector piece 18 may instead be associated with the second selector piece 19 and vice versa. For example, the grooves 42*a*, 42*b* may be provided in the first cylindrical surface 41.

In some embodiments, grooves may be provided in both the first and second cylindrical surfaces 41, 42.

The selector 14 may also be used with other types of product. Instead of being used as part of a smoking article 10, the selector 14 may be used with other types of tobacco industry products such as, for example, electronic cigarettes, inhalers, or other nicotine delivery systems. Such products need not include, for example, a main filter part 13, and may, for example, simply comprise a reservoir of flavourant or other inhalable substance, the level of delivery of which may be controlled by means of a flow control device as described.

The additive release component 17 may be a capsule having an outer shell, containing a smoke modifying agent in an interior cavity. The shell of the additive release component 17 may be frangible to release the smoke modifying agent on application of force. The inner filter part 15 may comprise a reaction surface against which the additive release component can be urged, in order to facilitate release of the smoke modifying agent.

The additive release component 17 may not be frangible, but may release the smoke modifying agent contents in a plurality of discrete doses, preferably actuated by a plurality of separate applications of force. This type of additive release component may comprise a resiliently or plastically deformable outer shell, for example configured to release doses of the smoke modifying agent through a slit formed in a pre-determined area.

The additive release component 17 may be spherical. Alternatively, the additive release component may be elongate, for example with a longitudinal axis extending coaxially with, or parallel to, the longitudinal axis 20 of the inner filter part 15.

The filter element 11 may comprise a plurality of additive release components 17. The multiple additive release components may be engineered to release smoke modifying agent substantially simultaneously in response to a single application of force. Alternatively, when multiple additive release components are present, the filter element may require a number of sequential applications of force for release of the smoke modifying agent from all of the additive release components.

The filter element 11 may comprise two, three, four or more additive release components. Multiple additive release components may be positioned, for example, at regularly spaced intervals along the length of the filter part. Alternatively, multiple additive release components may be located as a cluster. In some embodiments, the additive release components may be situated within a cavity formed between two sections of filter material.

The smoke modifying agent need not be included in an additive release component. In this case, the user does not need to first apply force to the filter element 11 to release the smoke modifying agent and can simply use the selector to change the proportion of modified smoke. In these embodiments, the first and second selector pieces 18, 19 may be positioned in the closed position prior to use to minimise diffusion of the smoke modifying agent out of the filter element 11.

The additive release component 17 comprises a smoke modifying agent, which may be any substance that may be added to the smoke flow path, for example to modify the composition or properties of smoke.

The smoke modifying agent held within the additive release component 17 may be a deodoriser, a diluent, an adsorbent, or any other substance that is capable of modifying the gaseous flow. The smoke modifying agent may be water. Where local regulations permit, the smoke modifying agent may be a flavourant.

As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, clove oil, eugenol, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other smoke modifying agents such as charcoal, chlorophyll, minerals, botanicals, or breath freshening agents. They may be imitation, synthetic or natural ingredients or blends thereof. They may be in any suitable form, for example, oil, liquid, or powder.

In particular, the smoke modifying agent may comprise menthol or eugenol.

The flavour may be a tobacco flavour. Where the flavour is delivered in liquid form the tobacco flavour could be derived from tobacco extract. Where the flavour is derived from a solid product, the product could be tobacco leaf in shredded, particulate or granular form, or in the form of reconstituted tobacco sheet material.

The smoke modifying agent may be a solid, such as a powder, a liquid, such as a liquid flavourant, deodoriser, water, etc, or a gas, such as an aromatic composition.

Where the smoke modifying agent or one of the smoke modifying agents includes activated carbon material, this can be included in the filter element in various ways. For example the activated carbon material may be held within a filter cavity. In addition, or alternatively, the activated carbon material may be included in the form of a charcoal patch on the inside of the barrier layer 23 or a layer of plugwrap material.

Embodiments of the invention are configured to comply with applicable laws and/or regulations, such as, by way of non-limiting example, regulations relating to flavours, additives, emissions, constituents, and/or the like. For example, the invention may be configured such that a smoking article implementing the invention is compliant with is applicable regulations before and after adjustment by a user. Such implementations may be configured to be compliant with applicable regulations in all user-selectable positions. In some embodiments, the configuration is such that a smoking article implementing the invention meets or exceeds required regulatory test(s) in all user-selectable positions, such as, by way of non-limiting example, the testing threshold(s)/ceiling(s) for cigarette emissions and/or smoke constituents.

In order to address various issues and advance the art, the entirety of this disclosure shows by way of illustration various embodiments in which the claimed invention(s) may be practiced and provide for a superior flow control device. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A flow control device for a smoking article, the device comprising first and second selector parts to control flow along a plurality of controllable flow channels, wherein the first and second selector parts are arranged to be axially displaceable to determine the number of controllable flow channels along which flow may be drawn, and wherein all of the controllable flow channels may be opened or closed by the axial displacement of the first selector part relative to the second selector part, wherein a first portion of one of the selector parts comprises a first channel and a second portion of one of the selector parts comprises a second channel, wherein the first channel extends axially further along the flow control device than the second channel, and wherein in a first position of relative axial displacement of the first and second selector parts, flow may be drawn along the first but not the second channel, and in a second position of relative axial displacement of the first and second selector parts, flow may be drawn along the first and second channels.

2. A flow control device as claimed in claim 1, wherein the first and second selector parts are configured to control flow through the flow control device in response to user action.

3. A flow control device as claimed in claim 1, wherein the first selector part comprises a first surface and the second selector part comprises a second surface, and wherein the controllable flow channels comprise flow between the first and second surfaces and do not comprise flow through an opening encompassed by either of the first or second surfaces.

4. A flow control device as claimed in claim 1, wherein the first and second surfaces are in contact in all relative positions of axial displacement of the first and second selector parts.

5. A flow control device as claimed in claim 1, wherein the first selector part comprises a cylindrical portion and the first surface comprises the outer circumferential surface of the cylindrical portion, and wherein the second selector part comprises a tubular portion, and the second surface comprises the cylindrical inner surface of the tubular portion, and wherein the cylindrical portion of the first selector part fits within a receiving end of the tubular portion of the second selector part.

6. A flow control device as claimed in claim 5, wherein the second surface comprises the first and second channels, which channels open at, and extend from, the receiving end of the second surface, and wherein the first channel extends further from the receiving end than the second channel.

7. A flow control device as claimed in claim 6, wherein in a first relative position of axial displacement of the first and second selector parts, in use flow may be drawn between the first and second surfaces along the first but not the second channel.

8. A flow control device as claimed in claim 7, wherein in a second relative position of axial displacement of the first and second selector parts, in use flow may be drawn between the first and second surfaces along both the first and second channels.

9. A flow control device as claimed in claim 1, wherein the controllable flow channels are controllable smoke flow channels.

10. A filter for a smoking article comprising the flow control device as claimed in claim 1.

11. A filter as claimed in claim 10, wherein the filter comprises first and second filter parts, wherein the first filter part comprises a smoke modifying agent, and wherein flow through the first filter part is controlled by the flow control device.

12. A smoking article comprising a flow control device as claimed in claim 1.

13. A smoking article comprising a filter as claimed in claim 10.

* * * * *